US008366408B2

(12) United States Patent
Wago et al.

(10) Patent No.: US 8,366,408 B2
(45) Date of Patent: Feb. 5, 2013

(54) EXTERNALLY ASSISTED VALVE FOR A POSITIVE DISPLACEMENT PUMP

(75) Inventors: Toshimichi Wago, Houston, TX (US); Philippe Gambier, Houston, TX (US); Jean-Louis Pessin, Houston, TX (US); Rajesh Luharuka, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 853 days.

(21) Appl. No.: 12/113,488

(22) Filed: May 1, 2008

(65) Prior Publication Data

US 2008/0279705 A1 Nov. 13, 2008

Related U.S. Application Data

(60) Provisional application No. 60/917,366, filed on May 11, 2007, provisional application No. 60/985,874, filed on Nov. 6, 2007.

(51) Int. Cl.
*F04B 49/03* (2006.01)

(52) U.S. Cl. ..... 417/298; 417/295; 417/311; 251/65

(58) Field of Classification Search ..... 417/109, 417/295, 298, 454, 510, 567, 311, 446, 503, 417/505, 506, 507, 508, 559, 561, 568; 251/65
See application file for complete search history.

(56) References Cited

U.S. PATENT DOCUMENTS

| | | | | |
|---|---|---|---|---|
| 1,633,035 | A * | 6/1927 | Reck | 417/446 |
| 1,759,301 | A * | 5/1930 | Dunn et al. | 137/340 |
| 2,131,749 | A * | 10/1938 | Ofeldt | 417/506 |
| 3,077,836 | A * | 2/1963 | Coberly et al. | 417/206 |
| 3,459,363 | A * | 8/1969 | Miller | 417/446 |
| 3,801,234 | A | 4/1974 | Love et al. | |
| 3,806,285 | A * | 4/1974 | Sech | 417/568 |
| 4,277,229 | A | 7/1981 | Pacht | |
| 4,432,386 | A | 2/1984 | Pacht | |
| 4,599,054 | A | 7/1986 | Spears | |
| 4,716,924 | A | 1/1988 | Pacht | |
| 4,768,933 | A | 9/1988 | Stachowiak | |
| 5,197,438 | A * | 3/1993 | Kumano et al. | 123/506 |
| 5,409,354 | A * | 4/1995 | Stangroom | 417/297 |
| 5,622,486 | A * | 4/1997 | McDuffie et al. | 417/536 |
| 5,803,122 | A | 9/1998 | Theilmeier | |
| 5,957,674 | A * | 9/1999 | Zenmei et al. | 417/505 |
| 6,045,334 | A * | 4/2000 | Murphy et al. | 417/53 |

(Continued)

FOREIGN PATENT DOCUMENTS

| | | |
|---|---|---|
| EP | 1296061 A2 | 3/2003 |
| EP | 1533516 A1 | 5/2005 |

OTHER PUBLICATIONS

Solenoid, http://en.wikipedia.org/w/index.php?title=Solenoid&oldid=443790091 (last visited Aug. 11, 2011).*

(Continued)

*Primary Examiner* — Charles Freay
*Assistant Examiner* — Patrick Hamo
(74) *Attorney, Agent, or Firm* — Myron Stout; Daryl Wright; Robin Nava

(57) ABSTRACT

A positive displacement pump having a valve with an actuation guide for assisting its actuation. The valve may be configured for controlling fluid communication relative to a chamber of the pump with the valve actuation guide positioned external to the chamber and configured to assist in the controlling. The valve actuation guide itself may include an arm extending into a valve actuation assembly below the valve. In such embodiments, the arm may be reciprocated by crankshaft, hydraulic, or other means. Alternatively, the valve actuation assembly may include electromagnetic means for assisting in actuation of the valve.

22 Claims, 5 Drawing Sheets

U.S. PATENT DOCUMENTS

| | | | | |
|---|---|---|---|---|
| 6,910,871 | B1 | 6/2005 | Blume | |
| 7,681,589 | B2 * | 3/2010 | Schwegman | 137/543.13 |
| 2003/0021703 | A1 * | 1/2003 | Wallis | 417/298 |
| 2003/0235508 | A1 * | 12/2003 | Vicars | 417/360 |
| 2006/0147317 | A1 | 7/2006 | Okamoto et al. | |
| 2006/0222518 | A1 * | 10/2006 | Oda et al. | 417/298 |
| 2006/0254357 | A1 * | 11/2006 | Ens et al. | 73/593 |
| 2007/0065302 | A1 * | 3/2007 | Schmitz | 417/298 |

OTHER PUBLICATIONS

Office Action of Chinese Patent Application Serial No. 200880024290.6 dated Apr. 6, 2012.

* cited by examiner

EXTERNALLY ASSISTED VALVE FOR A POSITIVE DISPLACEMENT PUMP

CROSS REFERENCE TO RELATED APPLICATION(S)

This Patent Document claims priority under 35 U.S.C. §119(e) to U.S. Provisional Application Ser. No. 60/917,366, entitled Valve for a Positive Displacement Pump filed on May 11, 2007, and Provisional Application Ser. No. 60/985,874, entitled Valve for a Positive Displacement Pump filed on Nov. 6, 2007, both of which are incorporated herein by reference in their entirety.

FIELD

Embodiments described relate to valve assemblies for positive displacement pumps used in high pressure applications. In particular, embodiments of positive displacement pumps employing mechanisms and supports for extending the life of pump valves, minimizing pump damage during operation, and improving volumetric efficiency are described.

BACKGROUND

Positive displacement pumps are often employed at oilfields for large high pressure applications involved in hydrocarbon recovery efforts. A positive displacement pump may include a plunger driven by a crankshaft toward and away from a chamber in order to dramatically effect a high or low pressure on the chamber. This makes it a good choice for high pressure applications. Indeed, where fluid pressure exceeding a few thousand pounds per square inch (PSI) is to be generated, a positive displacement pump is generally employed.

Positive displacement pumps may be configured of fairly large sizes and employed in a variety of large scale oilfield operations such as drilling, cementing, coil tubing, water jet cutting, or hydraulic fracturing of underground rock. Hydraulic fracturing of underground rock, for example, often takes place at pressures of 10,000 to 15,000 PSI or more to direct a solids containing fluid through a well to release oil and gas from rock pores for extraction. Such pressures and large scale applications are readily satisfied by positive displacement pumps.

As noted, a positive displacement pump includes a plunger driven toward and away from a pressurizable chamber in order to achieve pumping of a solids containing fluid. More particularly, as the plunger is driven away from the chamber, pressure therein reduces allowing a discharge valve of the chamber to close. The chamber is thus sealed off from the external environment while the plunger remains in communication with the chamber. As such, the plunger continues its retreat away from the chamber generating a lowered pressure with respect to suction therein. Eventually, this lowered pressure will reach a level sufficient to open a suction valve of the pump in order to allow an influx of fluid into the chamber. Subsequently, the plunger may be driven toward the chamber to once again effect a high pressure therein. Thus, the suction valve may be closed, the discharge valve re-opened, and fluid expelled from the chamber as indicated above.

The actuation of the suction and discharge valves is achieved primarily through reliance on pressure conditions generated within the chamber. That is, the amount of pressure required to open or close each valve is a function of the physical characteristics of the valve along with a spring employed to hold the valve in a naturally closed position relative to the chamber. Unfortunately, this results in a lack of direct control over valve actuation and leaves an inherent inefficiency in operation of the valves. For example, opening of a valve requires generation of enough of a pressure change so as to overcome the weight of the valve and nature of its spring. This is of particular note regarding the suction valve where, rather than opening immediately upon closure of the discharge valve, a lowered pressure sufficient to overcome the weight and nature of the suction valve and its spring must first be generated within the chamber (i.e. net positive suction head (NPSH)). This time delay in opening of the suction valve is an inherent inefficiency in operation of the pump. Indeed, for a standard positive displacement pump employed at an oilfield, a pressure of between about 10 PSI and about 30 PSI may be required within the chamber before the suction valve is opened.

Reliance solely upon internal chamber pressure to actuate valves results in an inherent inefficiency and a lack of direct control as indicated above. Of potentially greater concern however, is the fact that this manner of valve actuation often leaves the pump itself susceptible to significant damage as a result of cavitation and 'water hammering'. That is, as the plunger moves away from the chamber decreasing pressure therein, the inherent delay in opening of the suction valve may lead to the cavitation and subsequent water hammering as described below.

During the delay in opening of the suction valve, and in conjunction with the generation of lowered pressure in the chamber, the fluid may undergo a degree of cavitation. That is, pockets of vapor may form within the fluid and it may begin to vaporize in the face of the lowered pressure. Formation of vapor in this manner may be followed by rapid compression of the vapor back into liquid as the plunger once again advances toward the chamber. This rapid compression of the liquid is accompanied by a significant amount of heat and may also result in transmitting a degree of shock through the pump, referred to as water hammering. All in all, a significant amount of pump damage may naturally occur based on the pressure actuated design of a conventional positive displacement pump.

In order to address pump damage resulting from cavitation and water hammering, techniques are often employed in which acoustic data generated by the pump is analyzed during its operation. However, reliance on the detection of acoustic data in order to address pump damage fails to substantially avoid the development of pump damage from cavitation and water hammering in the first place. Furthermore, it is not uncommon for the damaged pump to be employed in conjunction with an array of additional pumps at an oilfield. Thus, the damage may see its effects at neighboring pumps, for example, by placing added strain on these pumps or by translation of the damaging water hammering effects to these pumps. Indeed, cascading pump failure, from pump to pump to pump, is not an uncommon event where a significant amount of cavitation and/or water hammering is found.

SUMMARY

A positive displacement pump is provided with a housing for a pressurizable chamber. The chamber may be defined in part by a valve thereof which may be employed for controlling fluid access to the chamber. The positive displacement pump may also include a valve actuation guide that is positioned at least partially external to the chamber and coupled to the valve so as to assist the controlling of the fluid access to the chamber.

DETAILED DESCRIPTION

Embodiments are described with reference to certain high pressure positive displacement pump assemblies for fracturing operations. However, other positive displacement pumps may be employed for a variety of other operations including cementing. Regardless, embodiments described herein employ positive displacement pumps with valves that are equipped with external actuation assistance. As such, valve actuation is not left solely to the buildup of cavitation-inducing conditions within a chamber of the pump which would have the potential to create significant pump damage through water hammering.

Figure 1:
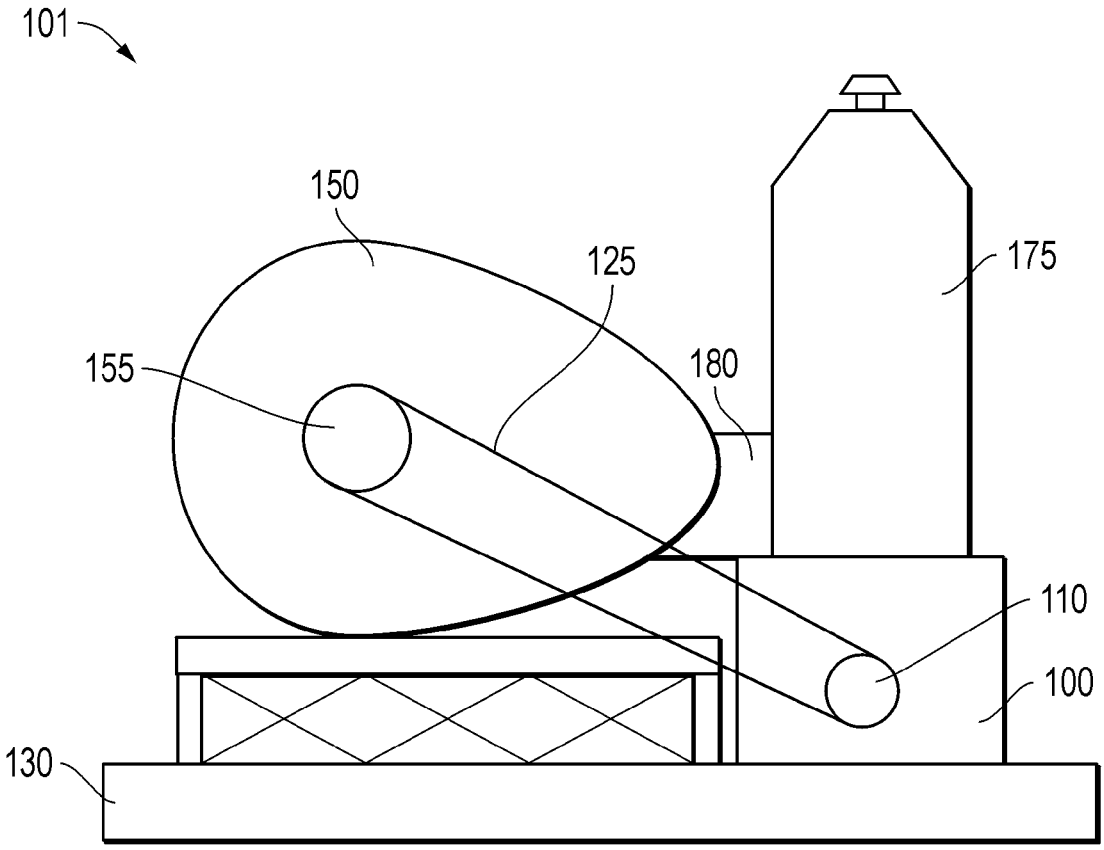
FIG. 1 is a side view of an embodiment of a positive displacement pump employing a valve actuation guide assembly.

Referring now to FIG. 1, an embodiment of a positive displacement pump 101 is shown which may employ a valve actuation guide assembly 100. The pump 101 may include a power supply depicted as a crankshaft housing 150 coupled to a plunger housing 180 which is in turn coupled to a chamber housing 175. In the embodiment shown, the pump components may be accommodated at a conventional skid 130 to enhance mobility, for example, for placement at an oilfield 501 (see FIG. 5). However, in other embodiments a pump truck or alternatively less mobile pump configurations may be employed. Additionally, the pump 101 may be of a conventional triplex configuration as depicted. However, other positive displacement pump configurations may also be employed.

Figure 2:
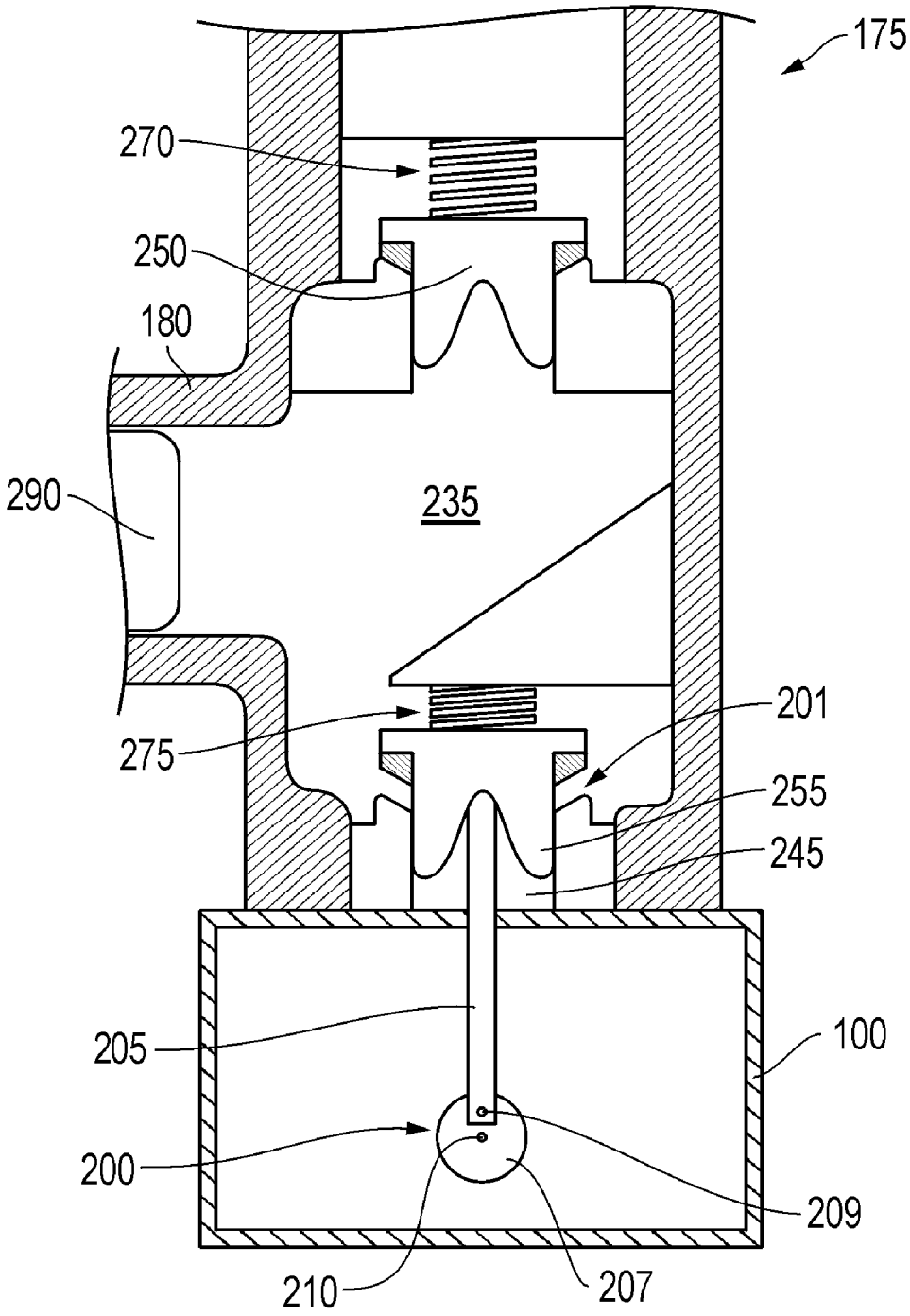
FIG. 2 is a cross-sectional view of the pump of FIG. 1 revealing an embodiment of a valve actuation guide of the assembly.

Continuing with reference to FIGS. 1 and 2, the chamber housing 175 of the pump 101 may be configured with valves (250, 255) to draw in, pressurize, and dispense an operation fluid. However, as indicated, the valve actuation guide assembly 100 may also be provided which is coupled to the chamber housing 175. The guide assembly 100 may be configured to assist valves (e.g. 250) in controlling or regulating fluid ingress and egress relative to the chamber housing 175. As detailed herein-below, this valve assistance provided by the guide assembly 100 may minimize pump damage during operation and enhance overall efficiency of the pump 101.

With particular reference to FIG. 2, a valve actuation guide 200 of the guide assembly 100 may be configured to assist in actuation of a valve 255 of the chamber housing 175. In the embodiment shown, the valve actuation guide 200 is mechanically coupled to the suction valve 255 of the chamber housing 175. However, in other embodiments, a valve actuation guide may similarly be coupled to the discharge valve 250 of the housing 175 or other valves not depicted. Additionally, as depicted in FIG. 2, the valve actuation guide 200 may be of a crank-driven configuration as described further below. However, in other embodiments, hydraulic, electromagnetic, or other valve actuation assistance may be employed.

Continuing with reference to FIGS. 1 and 2, the pump 101 is provided with a plunger 290 reciprocating within a plunger housing 180 toward and away from a pressurizable chamber 235. In this manner, the plunger 290 effects high and low pressures on the chamber 235. For example, as the plunger 290 retreats away from the chamber 235, the pressure therein will decrease. As the pressure within the chamber 235 decreases, the discharge valve 250 may close returning the chamber 235 to a sealed state. As the plunger 290 continues to move away from the chamber 235 the pressure therein will continue to drop, and eventually a lowered pressure may begin to arise within the chamber 235.

In spite of the potential development of lowered pressure within the chamber 235 as indicated above, significant cavitation may be avoided. That is, valve actuation assistance may be provided to the suction valve 255 to effect its opening as depicted in FIG. 2. As shown, the valve actuation guide 200 may be employed to ensure that the suction valve 255 is raised in order to allow a communication path 201 between a supply 245 of operation fluid and the chamber 235. As such, the uptake of operation fluid may be achieved without sole reliance on lowered pressure overcoming a suction spring 275. Thus, significant vaporization of operation fluid within the chamber 235 may be avoided.

Avoidance of significant vaporization of operation fluid in this manner may substantially minimize the amount of pump damage that may otherwise result as the plunger 290 repressurizes and condenses the operation fluid. That is, water-hammering damage due to the rapid condensing of vaporized operation fluid may be largely avoided. As such, in the embodiment shown, the plunger 290 may be thrust toward the chamber 235, increasing the pressure therein. The pressure increase will ultimately be enough to effect opening of the discharge valve 250 overcoming the force supplied by the discharge spring 270.

In an embodiment where the pump 101 is to be employed in a fracturing operation, pressures may be achieved in the manner described above that exceed 2,000 PSI, and more preferably, that exceed 10,000 PSI or more. Furthermore, such a positive displacement pump 101 is particularly well suited for high pressure applications of abrasive containing operation fluids. In fact, embodiments described herein may be applied to cementing, coil tubing, water jet cutting, and hydraulic fracturing operations as indicated, to name a few.

As indicated, the valve actuation guide 200 is configured to assist in actuation of the suction valve 255 as detailed above. However, the valve actuation guide 200 may take a variety of configurations in order to provide such assistance. For example, in the particular embodiment of FIG. 2, the valve actuation guide 200 is of a crank-driven configuration. As such, an arm 205 is provided extending from the suction valve 255 away from the chamber 235 and to the guide assembly 100. In the embodiment shown, the arm 205 is coupled to a rotable crankshaft 207 through a pin 209. The crankshaft 207 is rotable about a central axis 210. Thus, as the crankshaft 207 rotates, it serves to raise and lower the arm 205. In this manner, actuation of the suction valve 255 is achieved based on the rotation of the crankshaft 207 as opposed to sole reliance on lowered pressure within the chamber 235 as indicated above.

As indicated above, the proper timing for actuation of the suction valve 255 is dependent upon the position of the plunger 290, relative to the chamber 235. Thus, as described below, a mechanism for synchronizing the timing of the valve actuation guide 200 and its crankshaft 207 with the plunger 290 may be provided. Additionally, in the embodiment shown, the arm 205 is reciprocated in a rectilinear manner so as to maintain isolation between the guide assembly 100 and the operation fluid supply 245. This may be achieved through the employment of a crankshaft 207 of a conventional rectilinear effectuating crank design. Alternatively, other methods of sealing between the guide assembly 100 and the operation fluid supply 245 may be employed or a tolerable degree of communication there-between may be allowed.

As indicated above, and with added reference to FIG. 1, a mechanism for synchronizing the timing of the valve actuation guide 200 and the plunger 290 may be provided. As depicted in FIG. 1, the positive displacement pump 101 includes a timing mechanism in the form of a timing belt 125 running between the crankshaft housing 150 and the valve actuation guide assembly 100. More particularly, the timing belt 125 is positioned between a crank gear 155 at the crankshaft housing 150 and an assembly gear 110 at the guide assembly 100. The crank gear 155 may be coupled to the crankshaft of the crankshaft housing 150 which drives the plunger 290. By contrast, the assembly gear 110 may be coupled to the crankshaft 207 of the guide assembly 100. Thus, rotation of the crankshaft of the crankshaft housing 150 drives the plunger 290 as indicated, while also driving the valve actuation guide 200. Therefore, with appropriately sized intervening gears 155, 110 and other equipment parts, precise synchronized timing of the valve actuation guide 200 in line with the reciprocating plunger 290 may be achieved. Additionally, in other embodiments, the valve actuation guide 200 may be mechanically linked to the power output of the pump 101 through alternate means. Regardless, the volumetric efficiency of the pump operation may be enhanced in addition to the substantial elimination of cavitation and pump damage as described above with such a degree of synchronization employed.

Continuing with reference to FIG. 2, the arm 205 of the valve actuation guide 200 is depicted as a monolithic linkage between the suction valve 255 and the rotable crankshaft 207. However, in one embodiment the arm 205 may be contractible, similar to a conventional shock absorber. In this manner, the suction valve 255 may continue to be pressure actuated based on pressure within the chamber 235 in the event that the rotable crankshaft 207 ceases rotation or otherwise fails to properly operate. For example, with a contractible arm 205, the suction valve 255 may avoid being stuck in an open position as depicted in FIG. 2 should the valve actuation guide 200 malfunction or cease to operate.

The valve actuation guide 200 described above includes a crankshaft 207 for actuating the suction valve 255 in both an open direction, as depicted in FIG. 2, as well as in a closed direction (e.g. when the plunger 290 returns toward the chamber 235). However, this type of external valve assistance may take place to greater or lesser degrees. For example, in one embodiment, the valve actuation guide 200 may include a rotable cam in place of the rotable crankshaft 207. Thus, the arm 205 may be forced upward by the cam during its rotation in order to open the valve 255. However, returning closed of the valve 255 may be left to pressure buildup within the chamber 235. Thus, significant cavitation may be avoided as the suction valve 255 is opened without sole reliance on lowered pressure within the chamber 235. As such, employing a return of higher pressure within the chamber to close the suction valve 255 is less likely to result in any significant water hammering.

Similarly, the embodiments depicted reveal the guide assembly 100 and actuation guide 200 adjacent only to the suction valve 255. That is, actuation of the discharge valve 250 is left to pressure conditions within the chamber 235. This may allow for ease of design similar to cam actuation noted above and may be a practical option in light of the fact that significant cavitation is unlikely correlated to any discharge valve 250 position. However, in one embodiment external assistance is provided to the discharge valve 250 in addition to the suction valve 255. That is, an additional actuation guide similar to the embodiments described above may be positioned adjacent the discharge valve 250 and coupled thereto in order to further enhance pump efficiency. This may take place by reducing the amount of time that might otherwise be required to open or close the discharge valve 250 based solely on the pressure within the chamber 235.

Figure 3:
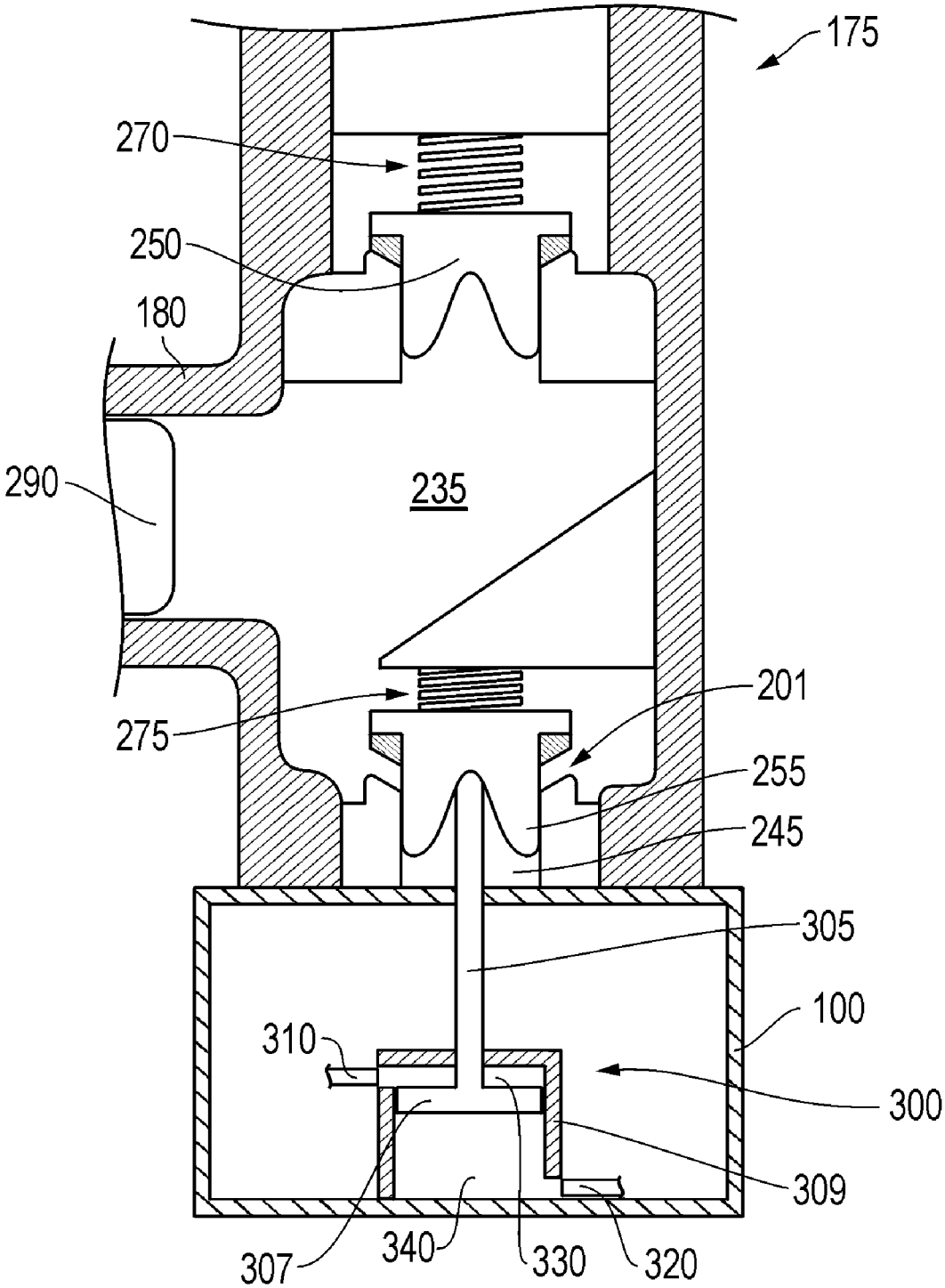
FIG. 3 is a cross-sectional view of the pump of FIG. 1 revealing an alternate embodiment of a valve actuation guide of the assembly.

Referring now to FIG. 3, an alternate embodiment of an actuation guide 300 is depicted within the guide assembly 100. Namely, a hydraulic actuation guide 300 may be employed in order to provide external assistance to a valve such as the depicted suction valve 255. In the embodiment shown, an arm 305 once again extends from the suction valve 255 to the external guide assembly 100 where it terminates at a plate 307 within a hydraulic chamber 309. As described below, hydraulic fluid within the chamber 309 may act upon the plate 307 in order to effect reciprocation of the arm 305. In this manner, the suction valve 255 may be assisted in either opening to the position shown in FIG. 3 or in closing.

Continuing with reference to FIG. 3, the actuation guide 300 includes the noted hydraulic chamber 309 which may be divided into a pump-side interior compartment 330 and an exterior compartment 340 at either side of the plate 307. Thus, an increase in pressure at the interior compartment may be employed to drive the arm 305 away from the adjacent pump equipment. In the case of the suction valve 255 coupled to the arm 305, this pressure increase results in a closing of the valve 255 and the communication path 201 between the fluid supply 245 and the pump chamber 235. Alternatively, a pressure increase within the exterior compartment 340 may act upon the opposite side of the plate 307 to drive the suction valve 255 into the open position depicted in FIG. 3. Of note is the fact that in an embodiment where a hydraulic actuation guide 300 is also coupled to the discharge valve 250, an increase in pressure at its pump side interior compartment would act to open the valve 250. Alternatively, an increase in pressure at the opposite exterior compartment would act to close the valve 250. This manner of actuation would be due to the unique orientation of the discharge valve 250 relative to the pump chamber 235.

Returning to the embodiment depicted in FIG. 3, the interior compartment 330 is served by an interior hydraulic line 310 whereas the exterior compartment is served by an exterior hydraulic line 320. Thus, in one embodiment a double acting hydraulic control mechanism may be disposed between the lines 310, 320 to drive hydraulic fluid between the lines 310, 320 in order to regulate pressure within the compartments 330, 340 as described. Alternatively, synchronized independently actuated double acting pneumatic actuators may be coupled to each line 310, 320 in order to direct pressures within the compartments 330, 340 and achieve reciprocation of the arm 305.

Similar to the crank-driven configuration of FIG. 2, the hydraulic valve actuation guide 300 of FIG. 3 provides valve actuation assistance to the suction valve in a manner substantially reducing cavitation or boiling of operation fluid within the chamber 235 during retreat of the plunger 290. Additionally, where the actuation guide 300 assists in both opening and closing of the suction valve 255 in a synchronized manner, volumetric efficiency of the pump is also enhanced. Furthermore, additional volumetric efficiency may be achieved in an embodiment where a hydraulic actuation guide 300 is also coupled to the discharge valve 250 as described above.

As in the case of the crank-driven configuration of FIG. 2, the arm 305 may also be of a shock-absorber configuration to ensure continued valve operation in the event of breakdown of the actuation guide 300. Additionally, the hydraulic actuation guide 300 may be employed for assistance in valve actuation in a single direction (e.g. opening of the suction valve 255 similar to the cam actuated embodiment described above).

Figure 4:
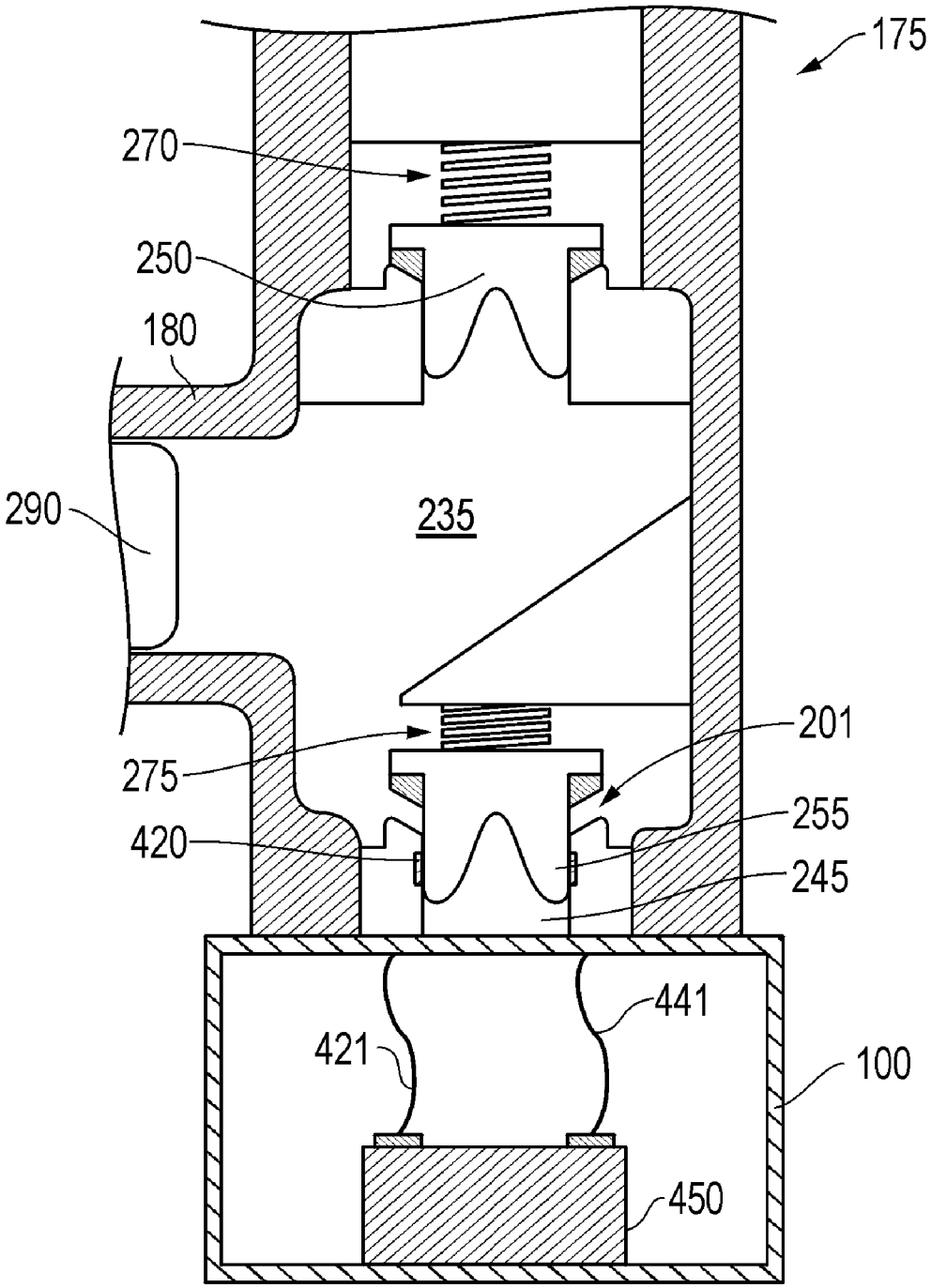
FIG. 4 is a cross-sectional view of the pump of FIG. 1 revealing another alternate embodiment of a valve actuation guide of the assembly.

Continuing now with reference to FIG. 4, another alternate embodiment of an actuation guide 450 is depicted within the guide assembly 100. In this case, the actuation guide is an electromagnetic power source that is wired through leads 421, 441 to an electromagnetic inductor 420. Thus, in the embodiment shown, the suction valve 255 may be of a conventional magnetic or other magneto-responsive material such that valve actuation may be directionally assisted based on the polarity of the inductors 420. That is, the inductor 420 may be of reversible polarity such that the valve 255 will either be assisted in opening or closing depending on the magnitude and polarity of the current through the inductor 420.

In the embodiment of FIG. 4, the actuation guide 450 remains entirely free of physical coupling to the suction valve 255 by way of imparting electromagnetic forces through the inductor 420 imbedded within the seat below the suction valve 255 and adjacent the fluid supply 245. However, in another embodiment, an arm similar to that of FIGS. 2 and 3 may be coupled to the valve 255 and extend toward the guide assembly 100. In such an embodiment, an inductive mechanism may be retained isolated from the fluid supply 245 where desired. Thus, the arm, as opposed to the valve 255 itself, may be made up of magnetic or magneto-responsive material and acted upon by the inductive mechanism to assist valve actuation similar to the mechanical and hydraulic embodiments depicted in FIGS. 2 and 3.

As with prior embodiments detailed above, the electromagnetic driven configuration of FIG. 4 provides valve actuation assistance to the suction valve in a manner substantially reducing cavitation. Additionally, where the actuation guide 450 induces a synchronized reverse of polarity to assist in both opening and closing of the suction valve 255, volumetric efficiency of the pump is also enhanced. Furthermore, additional volumetric efficiency may be achieved in an embodiment where an electromagnetic actuation guide 450 is also coupled to the discharge valve.

With particular reference to FIGS. 3 and 4, hydraulic and electromagnetic valve actuation assistance may be particularly well suited for non-mechanical synchronization with the power output of the pump. That is, rather than physically employing a timing belt 125 to link power output and the guide assembly 100, the position of the plunger 290 or other pump parts may be monitored via conventional sensors and techniques. This information may then be fed to a processor where it may be analyzed and employed in actuating the hydraulic 300 or electromagnetic 450 actuation guides employed. Indeed, with such techniques available, actuation assistance may be tuned in real-time to ensure adequate avoidance of cavitation and maximization of volumetric pump efficiency.

Continuing with reference to the embodiments of FIGS. 3 and 4, non-intrusive actuation assistance in the form of hydraulic 300 or electromagnetic 450 actuation guides provides additional advantages. For example, there is a reduction in the total number of mechanical moving parts which must be maintained. Indeed, in the case of electromagnetic actuation, in particular, the option of eliminating an arm coupled to the valve 255 alleviates concern over the potential need to maintain a sealed off fluid supply 245.

Figure 5:
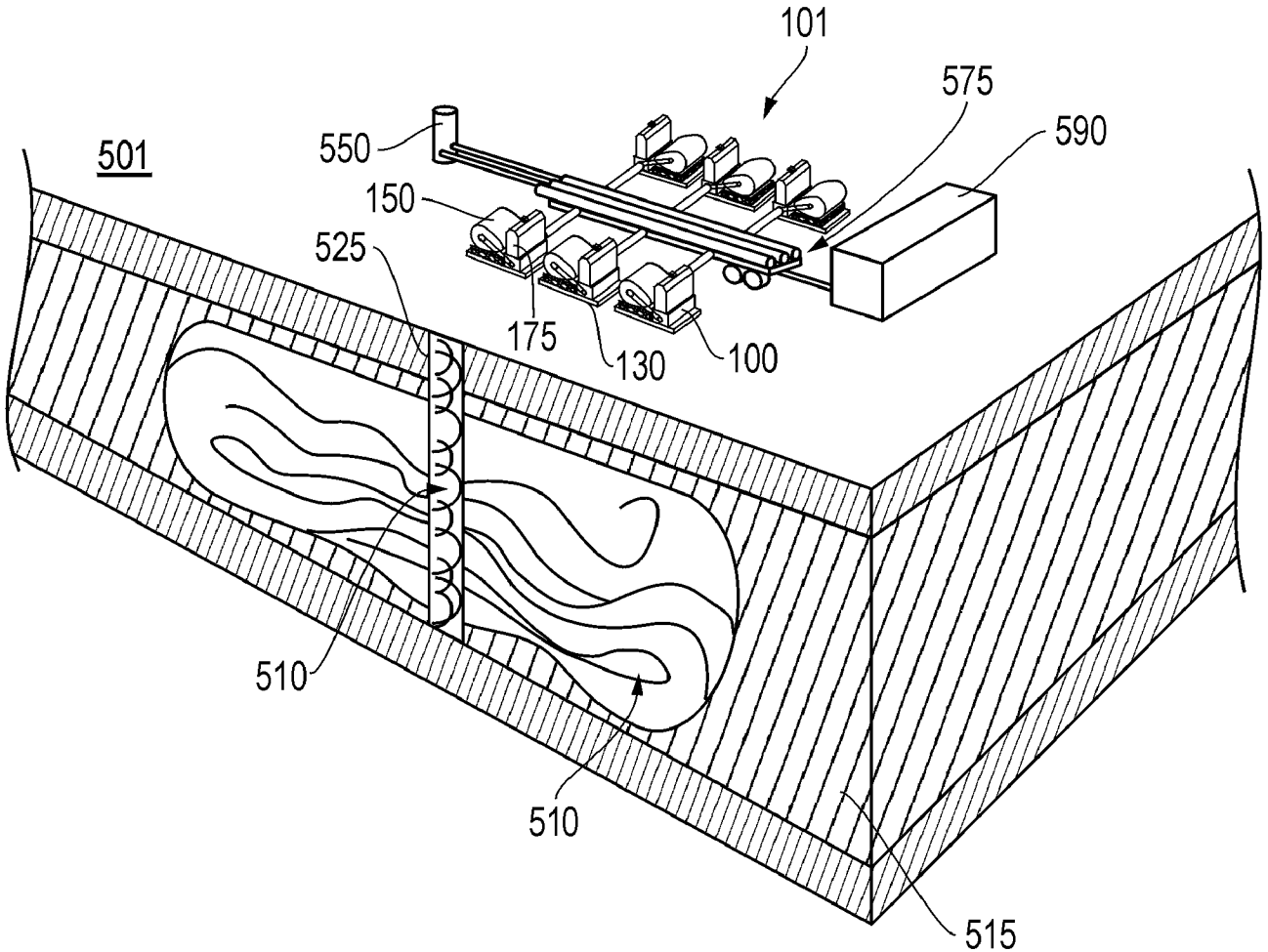
FIG. 5 is a partially sectional overview of an oilfield employing the pump of FIG. 1 as part of a multi-pump operation.

Referring now to FIG. 5, a partially sectional view of an oilfield 501 is depicted whereat pumps 101 such as that of FIG. 1 are employed as part of a multi-pump operation. Each pump 101 is equipped with a crankshaft housing 150 adjacent a chamber housing 175 and positioned atop a skid 130. However, in order to reduce cavitation and pump damage, the pumps 101 are also each equipped with an externally positioned guide assembly 100 to assist in valve actuation within the chamber housing 175 as detailed in embodiments above. Overall pump efficiency may also be enhanced for each of the pumps 101 in this manner. Thus, inadequate operation of any given pump 101 is unlikely to occur or place added strain on neighboring pumps 101.

In the particular depiction of FIG. 5, the pumps are acting in concert to deliver a fracturing fluid 510 through a well 525 for downhole fracturing of a formation 515. In this manner, hydrocarbon recovery from the formation 515 may be stimulated. Mixing equipment 590 may be employed to supply the fracturing fluid 510 through a manifold 575 where pressurization by the pumps 101 may then be employed to advance the fluid 510 through a well head 550 and into the well 525 at pressures that may exceed about 20,000 PSI. Nevertheless, due to cavitation avoidance as a result of the employed guide assemblies 100, pump damage due to water hammering may be kept at a minimum.

Embodiments described hereinabove address cavitation, pump damage and even pump efficiency in a manner that does not rely solely upon internal pump pressure for valve actuation. As a result, delay in opening of the suction valve in particular may be avoided so as to substantially eliminate cavitation and subsequent water hammering. Indeed, as opposed to mere monitoring of pump conditions, embodiments described herein may be employed to actively avoid pump damage from water hammering.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, valve actuation assistance may be achieved through the use of servo and/or stepped motors. The assistance as detailed herein may also be employed to extend the life of valves by increasing the rate of valve closure so as to ensure more effective crushing of abrasives carried by operation fluid. Additionally, volumetric efficiencies enhanced by valve actuation assistance as described herein may be even further enhanced by ensuring that valve opening is maximized during pumping. Furthermore, the foregoing description should not be read as pertaining only to the precise structures described and shown in the accompanying drawings, but rather should be read as consistent with and as support for the following claims, which are to have their fullest and fairest scope.

We claim:

1. A positive displacement pump comprising:

a housing for a pressurizable chamber;

a plunger configured to reciprocate inside the pressurizable chamber;

a valve of said housing for controlling fluid communication with the pressurizable chamber;

a valve actuation guide external to the pressurizable chamber connected to said valve by a coupling to assist opening or closing the valve to control fluid communication with the pressurizable chamber; and, a timing mechanism for controlling a timing of when the valve actuation guide assists opening or closing the valve relative to a position of the plunger inside the pressurizable chamber, and wherein the timing mechanism is selected from the group consisting of (i) a timing belt, and (ii) a sensor to monitor said position of said plunger and a processor to analyze data from said sensor.

2. The positive displacement pump of claim 1 wherein the coupling is of an electromagnetic nature.

3. The positive displacement pump of claim 2 wherein said valve actuation guide is an electromagnetic power source coupled to at least one electromagnetic inductor and said valve is of a magneto-responsive material.

4. The positive displacement pump of claim 3 wherein the at least one electromagnetic inductor is of reversible polarity.

5. The positive displacement pump of claim 3 wherein the at least one electromagnetic inductor is accommodated at a valve seat for contacting said valve.

6. The positive displacement pump of claim 1 further comprising a mechanical arm disposed between said valve and said valve actuation guide for the coupling.

7. The positive displacement pump of claim 6 wherein said mechanical arm is of a contractible configuration.

8. The positive displacement pump of claim 6 wherein said valve actuation guide is configured to drive said mechanical arm and assist the valve to control fluid communication with the pressurizable chamber by one of a cam mechanism, a crank mechanism, a hydraulic mechanism, an electromagnetic mechanism, a servo motor, and a stepper motor.

9. The positive displacement pump of claim 8 wherein said valve actuation guide is configured to drive said mechanical arm by the hydraulic mechanism, said mechanical arm further comprises a plate, the hydraulic mechanism having a hydraulic mechanism housing disposed about said plate to form a pressurizable compartment on at least one side of the plate, said mechanical arm configured to reciprocate in accordance with a pressure of the pressurizable compartment when the mechanical arm is driven by the valve actuation guide.

10. The positive displacement pump of claim 8 wherein said valve actuation guide is configured to drive said mechanical arm by the electromagnetic mechanism, said valve actuation guide is an electromagnetic power source and the electromagnetic mechanism includes at least one electromagnetic inductor.

11. The positive displacement pump of claim 10 wherein said mechanical arm is of a magneto-responsive material.

12. The positive displacement pump of claim 10 wherein the at least one electromagnetic inductor is of reversible polarity.

13. The positive displacement pump of claim 1 further comprising:

a power supply;

the plunger coupled to said power supply and in communication with the pressurizable chamber to direct a pressurization of the pressurizable chamber; and where the timing mechanism is a timing belt, the timing mechanism disposed between said power supply and said valve actuation guide.

14. The positive displacement pump of claim 1 wherein control of the timing for when the valve actuation guide assists opening or closing the valve to control fluid communication with the pressurizable chamber is tunable in real-time.

15. The positive displacement pump of claim 1 wherein said valve is a first valve and said valve actuation guide is a first valve actuation guide for connecting to said first valve, the positive displacement pump further comprising:

a second valve of said housing for controlling fluid communication with the pressurizable chamber; and a second valve actuation guide coupled to said second valve to assist opening or closing the second valve to control fluid communication with the pressurizable chamber.

16. The positive displacement pump of claim 1 wherein the valve is configured to move in a direction that is substantially perpendicular to a reciprocating movement of the plunger.

17. A positive displacement pump assembly for positioning at an oilfield to deliver a fluid to a well thereat during an operation, the positive displacement pump assembly comprising:

a housing for a pressurizable chamber;

a plunger configured to reciprocate inside the pressurizable chamber;

a supply of the fluid adjacent the pressurizable chamber;

a valve of said housing for controlling access by the fluid to the pressurizable chamber;

a valve actuation guide external to the pressurizable chamber connected to the valve by a coupling to assist opening or closing the valve to control fluid communication with the pressurizable chamber; and, a timing mechanism for controlling a timing of when the valve actuation guide assists opening or closing the valve relative to a position of the plunger inside the pressurizable chamber, and wherein the timing mechanism is selected from the group consisting of (i) a timing belt, and (ii) a sensor to monitor said position of said plunger and a processor to analyze data from said sensor.

18. The positive displacement pump assembly of claim 17 wherein the coupling is one of a mechanical coupling and an electromagnetic coupling.

19. The positive displacement pump assembly of claim 17 wherein the operation is one of fracturing and cementing.

20. A valve actuation guide assembly for positioning adjacent a housing for a pressurizable chamber of a positive displacement pump, the valve actuation guide assembly comprising an actuation guide connected to a valve of the housing by a coupling to control fluid communication with the pressurizable chamber, wherein said actuation guide assists opening or closing the valve to control fluid communication with the pressurizable chamber, and a timing mechanism for controlling a timing of when the valve actuation guide assists opening or closing the valve relative to a position of the plunger inside the pressurizable chamber, and wherein the timing mechanism is selected from the group consisting of (i) a timing belt, and (ii) a sensor to monitor said position of said plunger and a processor to analyze data from said sensor.

21. The valve actuation guide assembly of claim 20 wherein the coupling is one of electromagnetic and mechanical.

22. The valve actuation guide assembly of claim 20 wherein the valve is configured to move in a direction that is substantially perpendicular to a reciprocating movement of the plunger.

* * * * *